US005294018A

United States Patent [19]

Boucher

[11] Patent Number: 5,294,018

[45] Date of Patent: Mar. 15, 1994

[54] SELF RIGHTING DRINKING CUP WITH TWIST ON BASE

[75] Inventor: Richard A. Boucher, Ashburnham, Mass.

[73] Assignee: Sanitoy, Inc., Fitchburg, Mass.

[21] Appl. No.: 7,166

[22] Filed: Jan. 21, 1993

[51] Int. Cl.[5] ..... A47G 19/22

[52] U.S. Cl. ..... 220/603; 215/100 A; 220/630; 220/711; 220/771; 220/772

[58] Field of Search ..... 220/213, 215, 603, 630, 220/703-712, 771, 772; 248/346.1, 910; 215/101, 100 R

[56] References Cited

U.S. PATENT DOCUMENTS

| | | | |
|---|---|---|---|
| D. 165,778 | 1/1952 | Olsen | D7/510 |
| D. 216,730 | 3/1970 | Carslaw | D7/510 |
| D. 233,972 | 12/1974 | Juhlin | D7/511 |
| D. 329,355 | 9/1992 | Yagi | D7/511 |
| 610,285 | 9/1898 | Scoles | 220/603 |
| 1,300,867 | 4/1919 | Pick | 220/603 |
| 1,347,357 | 7/1920 | Wright | 220/630 |
| 2,545,320 | 3/1951 | Tilson et al. | 220/630 X |
| 2,587,237 | 2/1952 | Sinaiko | 220/603 X |
| 2,601,767 | 7/1952 | Wall | 220/603 |
| 2,792,696 | 5/1957 | Stayart | 215/11.1 X |
| 4,040,549 | 8/1977 | Sadler | 248/346.1 X |
| 4,096,966 | 6/1978 | Korshak | 220/603 |
| 4,121,731 | 10/1978 | Okerstrum | 220/215 |
| 4,127,211 | 11/1978 | Zerbey | 220/630 X |
| 4,146,157 | 3/1979 | Dixon, Sr. et al. | 220/203 X |
| 4,303,170 | 12/1981 | Panicci | 220/603 |
| 4,388,996 | 6/1983 | Panicci | 220/603 |
| 4,953,737 | 9/1990 | Meyers | 220/217 X |

FOREIGN PATENT DOCUMENTS

| | | | |
|---|---|---|---|
| 1164969 | 9/1969 | United Kingdom | 220/603 |
| 1229426 | 4/1971 | United Kingdom | 220/213 |
| 2187722 | 9/1987 | United Kingdom | 215/11.6 |

*Primary Examiner*—Sue A. Weaver
*Attorney, Agent, or Firm*—Davis, Bujold & Streck

[57] ABSTRACT

According to the invention there is drinking cup having a flat bottom and two large diametrically opposed handles. A removable lid with a drinking spout and an air vent is provided to prevent spillage. A separate weighted convex base is attached to the base of the cup to automatically right the cup under the force of gravity. The bottom of the cup and the top of the base are provided with a circular groove and a mating circular ridge. The ridge and the groove positively engaged to align the base horizontally in place on the bottom of the cup while permitting rotation of the base relative to the cup. Two diametrically opposed generally C-shaped clips are located on the edge of the base and extend upwards from the edge of the base and face in opposite directions in order to engaged the handles on the cup upon rotation of the base.

11 Claims, 3 Drawing Sheets

SELF RIGHTING DRINKING CUP WITH TWIST ON BASE

The present invention relates to a self righting drinking cup having a novel construction for quick and easy attachment and removal of a separate convex base member.

BACKGROUND OF THE INVENTION

Known prior art self righting drinking cups are disclosed by U.S. Pat. Nos. 2,601,767, 4,303,170, 4,388,996 and U.S. Pat. No. 216,730. These prior art devices disclose a single piece cup having an integral weighted convex base member for righting the cup. The weighted base on these prior art devices is not removable.

U.S. Pat. No., 4,096,966 teaches a self righting drinking cup having a separate removable convex weighted base so that the cup may be used as a conventional cup. However, the base member is adapted to engage the cup to form a push or screw fit. The objective of the instant invention is to provide positive engagement between the base member and the cup providing a more secure attachment of the base to the cup than a push fit, and to provide a quicker and easier release and attachment than a screw fit.

SUMMARY OF THE INVENTION

According to the invention there is provided a generally cylindrical drinking cup having a flat bottom and two large diametrically opposed handles for easy grasping by an infant. A removable lid is provided to prevent spillage. A drinking spout is located on one side of the lid and there is a vent hole in the side of the lid opposite the spout. A separate weighted convex base is attached to the base of the cup to automatically right the cup under the force of gravity.

The bottom of the cup and the top of the base are provided with a circular groove and a mating circular ridge concentric to a vertical axis that passes through the center of the cup. The ridge and the groove positively engage to align the base horizontally in place on the bottom of the cup while permitting rotation of the base relative to the cup. Two diametrically opposed generally C-shaped clips are located on the edge of the base. The clips extend upwards from the edge of the base and face in opposite directions in order to engaged the handles on the cup upon rotation of the base.

The convex bottom is locked in place on the bottom of the cup by rotationally spacing the clips from the handles and axially engaging the groove in the ridge, and rotating the base in relation to the cup to engage the clips on the handle. In this way, the base is horizontally aligned on the bottom of the cup by the engagement of the groove and the ridge, and vertically and horizontally locked in place by the engagement of the clips on the handles.

Attachment of the base to the cup in accordance to the invention is achieved through a partial rotation of the base relative to the cup requiring just a single twist of the wrist, thereby providing a quicker and easier attachment and removal of the base than a screw on base.

BRIEF DESCRIPTION OF THE DRAWINGS

The preferred embodiments of the invention will now be described, by way of example, with reference to the accompanying drawings, in which.

DETAILED DESCRIPTION OF THE INVENTION

Figure 1:
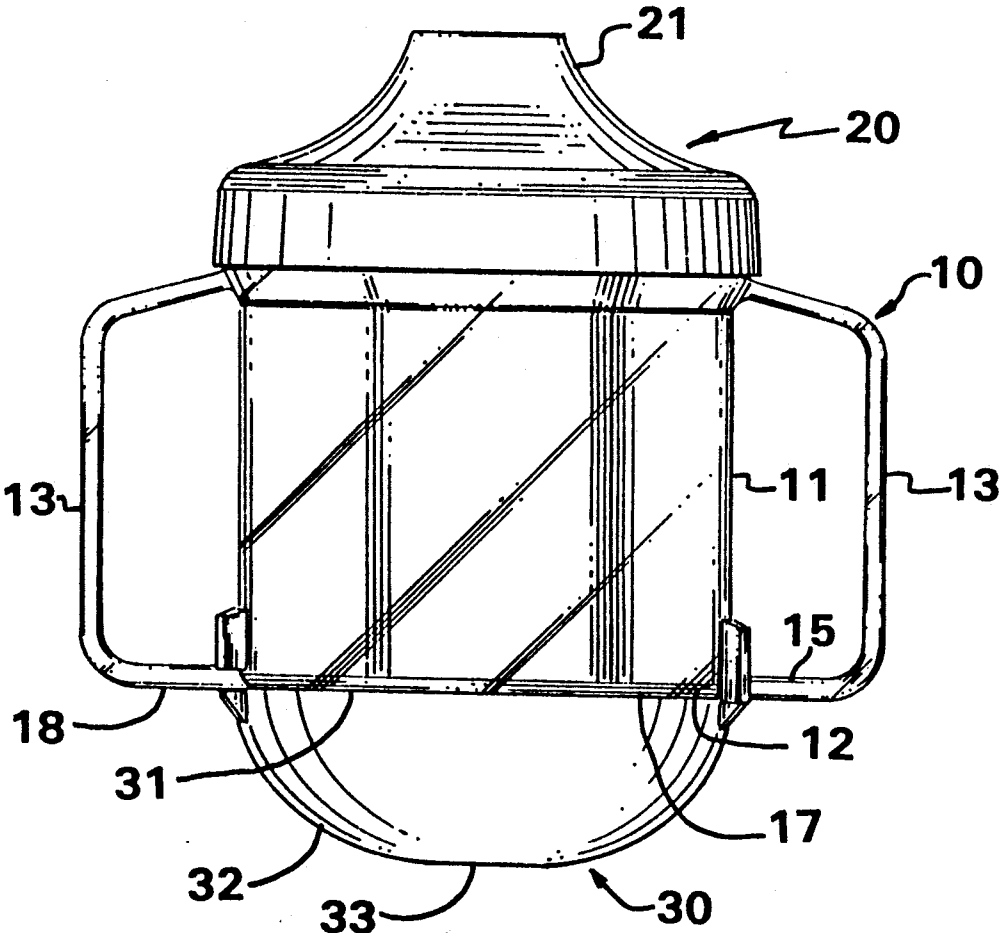
FIG. 1 is a partially broken away front view of the drinking cup made in accordance with the invention.

FIG. 1 shows a drinking cup 10 in accordance to the invention with a removable lid 20 and a removable base 30. The cup 10 has a cylindrical sidewall 11. The sidewall 11 is enclosed at the bottom by a bottom wall 12 and is open at the top. Two radially extending handles 13 are attached to the cup on diametrically opposite sides of the sidewall 11. The handles are preferably large and generally arched shaped for easy grasping by an infant.

A removable lid 20 is sealingly secured to the top rim of the cup 10 by conventional screw threads or conventional friction or snap fit. A drinking spout 21 is located toward one side of the lid and a vent hole 23 is located toward the other side of the lid. See FIG. 3. The drinking spout has at least one hole 22 passing therethrough into the interior of the cup for liquids to pass therethrough. Preferably there are three small holes 22 in the drinking spout to avoid excess spillage if the cup is placed on its side or knocked over.

A removable weighted base member 30 provides the self righting action of the cup 10. The base member 30 has a generally planar upper surface 31, see FIG. 5, and a generally hemispherical convex sidewall 32. Sidewall 32 is concentric to a vertical axis AA that passes through the center of the cup. See FIG. 1. The diameter of sidewall 32 increasingly decreases from the upper surface 31 to a planar bottom surface 33 upon which the cup rests on a flat surface such as a table. See FIGS. 1 and 2. The base member 30 is weighted with its center of gravity located at the vertical axis AA. In this way, when the cup is set down on its side or at an angle the force of gravity pulls down on the weighted base such that the cup rocks along the convex outer surface of the base 32 and comes to rest on the planar bottom surface 33 of the base, thereby automatically righting itself.

The upper surface 31 of the base member 30 has a circular groove 34 therein that is concentric to the central axis AA of the drinking cup. See FIG. 5. The lower surface 17 of the bottom wall 12 of the cup 10 has two arcuate ridges 16 that are concentric to central axis AA and are of the same diameter as the groove 34 in the base member 30. The ridges on the cup are sized to fit snugly but in sliding engagement in the grooves on the base to align the base horizontally in place on the bottom of the cup concentric to central axis AA in a rotatably slidable fashion.

Alternatively, there may be a single circular ridge on the bottom of the cup or a plurality of arcuate ridges along the circle without departing from the scope of the invention. Any other arrangement of bosses and recesses that would align the base with the bottom of the cup and permit rotation of the base relative to the cup may also be used without departing from the scope of the invention.

Two diametrically opposed C-shaped clip fasteners 35 are located on the outer edge of the base member and extend upwards from the base member along the sidewall 11 of the cup. The two C-shaped fasteners face in opposite directions so that upon rotation of the base they engaged the handles 13. see FIGS. 1 and 2. Preferably handles 13 are substantially vertically oriented and are attached to the lower edge of the cup by substantially horizontal legs 15 and 18 for engagement by the clips 35.

The base is quickly and easily attached to the lower surface of the cup by holding the base member with the C-shaped clips rotationally spaced from the handles, vertically engaging the groove and the ridge, and rotating the base clockwise relative to the base member with a single twist of the wrist to-engage the clips with the handles. The C-shaped clips 35 are preferably made from a resilient plastic material and have knobs 37 on the ends that partially enclose the opening 36 in the C-shaped clips. Upon rotation of the base on the bottom of the cup the knobs 37 contact the legs 18 of the handles resiliently opening the C-shaped clips as the knobs pass over the legs on the handles. Upon passing over the handles the C-shaped clips resiliently close such that the knobs 37 positively lock the clips on the handles. See FIG. 2. In this way, the C-shaped clips securely lock the base in place on the lower surface of the cup, securely holding the base vertically and rotationally along central axis AA in a quickly fastenable and releasable manner.

The lid 20, the cup 10 and base 30 are preferably molded from a plastic material by conventional molding processes. The cup 10 should be made from a shatter resistant plastic to avoid injury. The base 30 should be made out of a resilient plastic so that the clips can be resiliently biased over the handles. The base 30 is preferably weighted by a large disc shaped metal weight 39 contained within the base.

Since certain changes may be made in the above drinking cup without departing from the spirit and scope of the invention herein, it is intended that all matter contained in the above description and shown in the accompanying drawings shall not be construed as limiting the invention but shall be interpreted as illustrating the inventive concept involved herein.

I Richard A. Boucher have invented a design for a SELF-RIGHTING DRINKING CUP.

Figure 2:
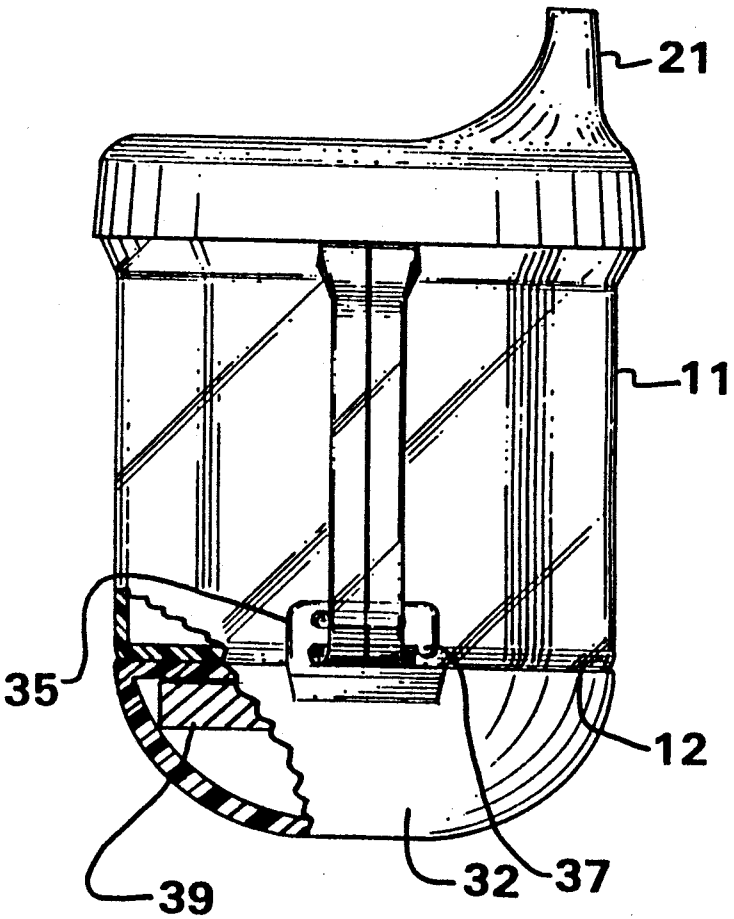
FIG. 2 is a partially broken away side view of the drinking cup shown in FIG. 1.
Figure 3:
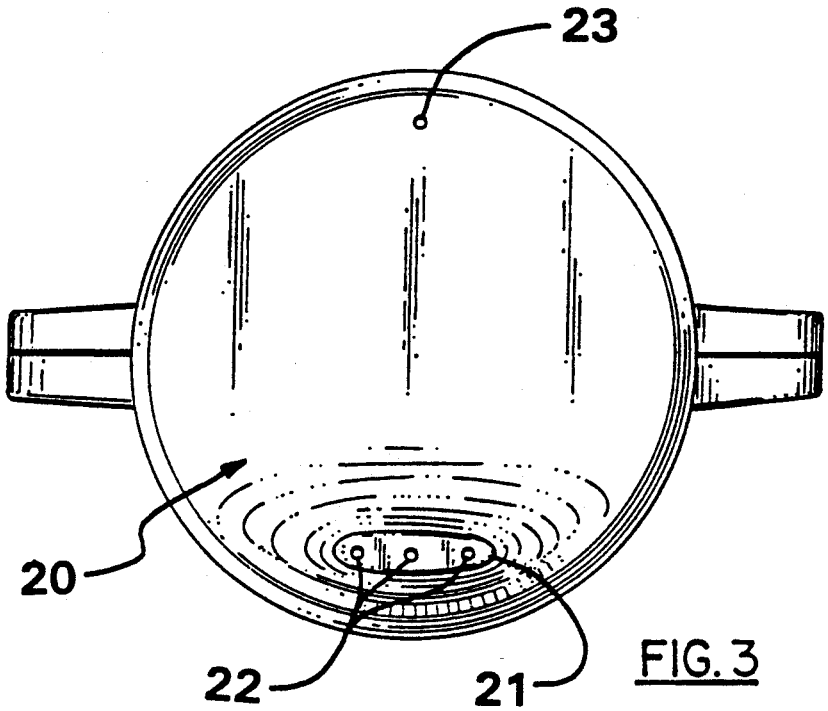
FIG. 3 is a top view of the drinking cup shown in FIG. 1.
Figure 4:
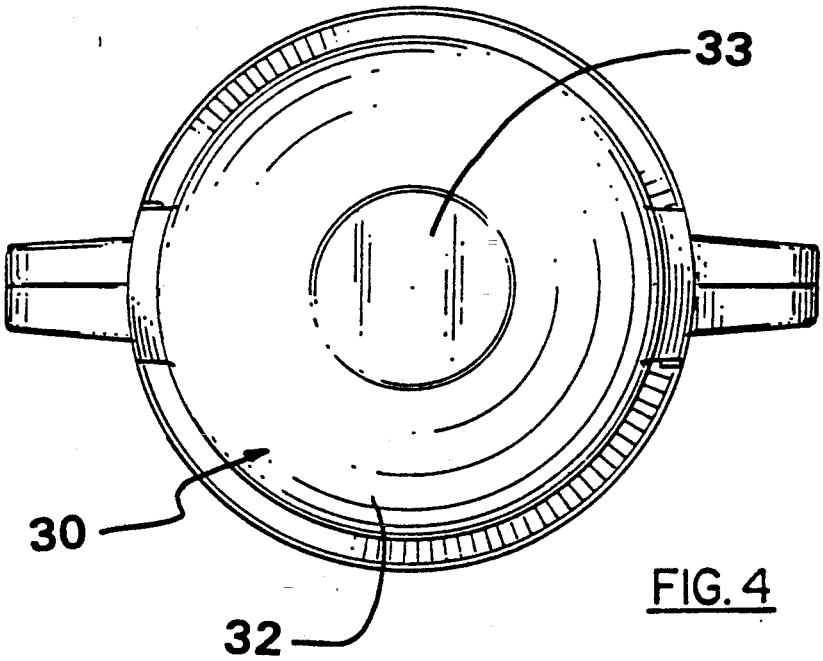
FIG. 4 is a bottom view of the drinking cup shown in FIG. 1.
Figure 5:
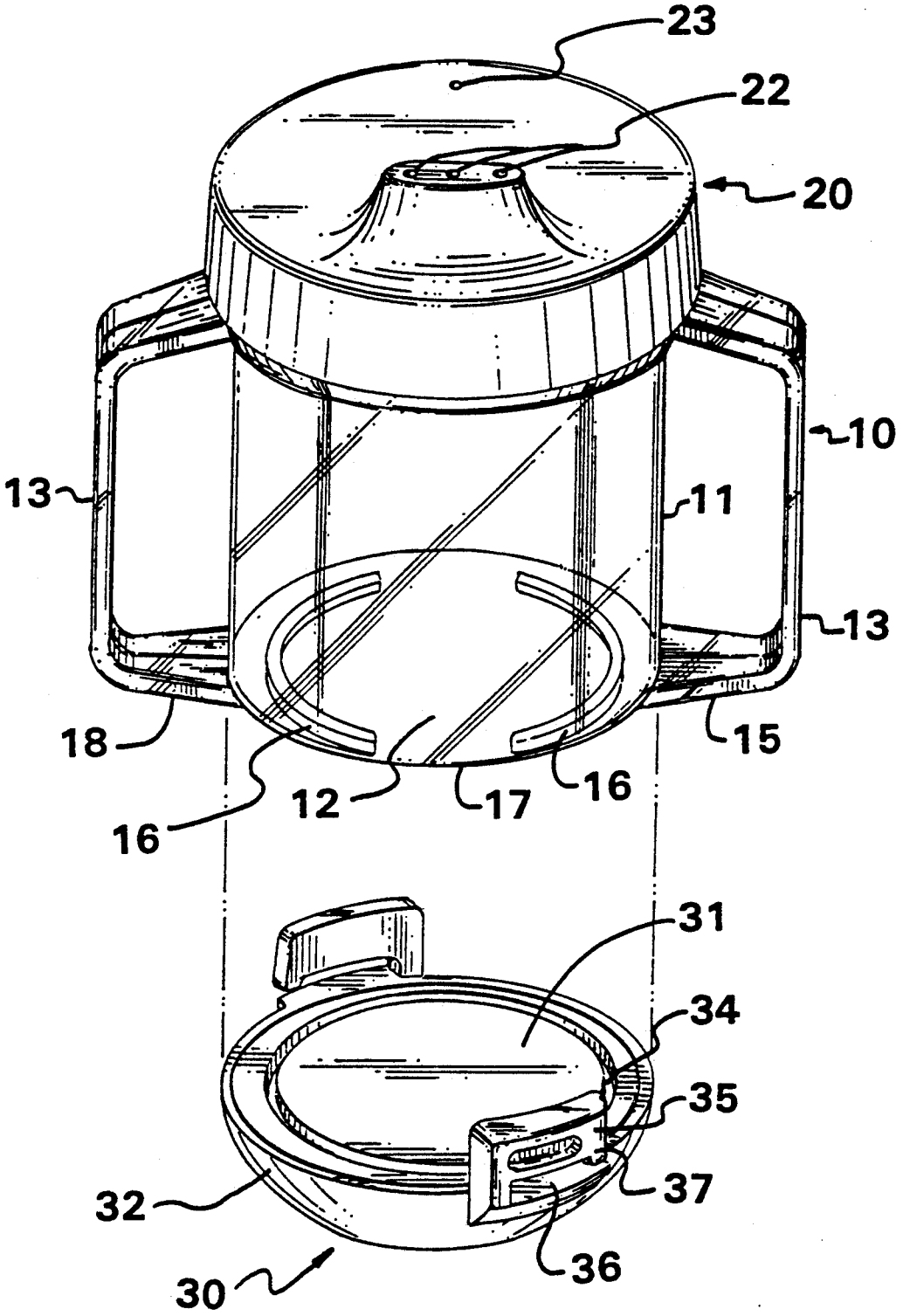
FIG. 5 is a perspective exploded view of the drinking cup as shown in FIG. 1.

A description of each figure of the drawings is as follows:

FIG. 1 is a front view of a self-righting cup embodying my design;

FIG. 2 is a side view of the self-righting cup of FIG. 1;

FIG. 3 is a top view of the self-righting cup of FIG. 1;

FIG. 4 is a bottom view of the self-righting cup of FIG. 1;

FIG. 5 is a perspective exploded view of the self-righting cup of FIG. 1.

What is claimed is:

1. A self righting drinking cup comprising:

a hollow cup container having a substantially cylindrical vertical sidewall, a substantially planar horizontal bottom wall enclosing the bottom of said cup container, said bottom wall having a substantially planar lower surface, a weighted base member having an upper surface, a rounded convex outer surface that tapers from said upper surface to a planar circular horizontal bottom surface upon which the cup stands when placed upon a flat surface, said convex outer surface and said bottom surface are concentric to a vertical axis which passes through the center of said cup, at least one arcuate ridge concentric to said vertical axis and a circular groove concentric to said vertical axis, one of said ridge and said groove being on said lower surface of said cup container and the other of said ridge and said groove being on said upper surface of said base member, and said ridge and said groove being sized such that said ridge is received in said groove in a closely mating and rotatably sliding fashion in order to align said base member horizontally in place on said cup container, two arcuate-shaped handles extending radially out from diametrically opposite sides of the sidewall of said cup container, said handles being substantially vertical and attached to said sidewall adjacent the top and bottom edges of the sidewall, two resilient C-shaped clips extending upwards from diametrically opposite edges of said upper surface of said base member and extending along the sidewalls of said cup container, said C-shaped clips forming openings therein, said openings facing in the same circumferential direction around said base member and being sized to resiliently receive the lower ends of said handles upon rotation of said base member in order to secure said base member vertically and rotationally in relation to said cup container.

2. A self righting cup as in claim 1, wherein two knobs are located on the ends of said resilient C-shaped clips partially enclosing the mouth of said openings in said clips to resiliently lock said handles in said openings and securely hold said base member on said cup container.

3. A self righting cup as in claim 1, further comprising a removable lid sealingly secured on the top edge of the sidewall to prevent spillage, a drinking spout on top of said lid adjacent one side of said lid, at least one hole in said spout that passes through said spout into the interior of said cup to allow the passage of liquid therethrough, a vent hole that passes through said lid adjacent the edge of said lid opposite said spout.

4. A self righting cup as in claim 3, wherein said removable lid is sealingly secured on the top edge of said sidewall by a friction fit.

5. A self righting cup as in claim 1, wherein a metal weight is located inside said base member.

6. A self righting cup as in claim 1, further comprising, a lid releasably and sealingly secured to the top of said sidewall, a drinking spout is located on top of said lid to one side of said lid, a vent hole passes through the top of said lid to the side of said lid opposite said drinking spout.

7. A self righting cup with a removable base comprising:

a hollow cup member having a tubular side wall, a bottom wall closing the bottom of said tubular sidewall, said bottom wall having a substantially planar lower surface, two generally arcuate shaped handles extending radially out from diametrically opposite sides of said sidewall, said handles are substantially vertical and are attached to the sidewall adjacent the top and bottom edges of said sidewall, a lid is sealingly secured to the top of said sidewall, a drinking spout is located on top of said lid to one side of said lid, a vent hole passes through the top of said lid to the side of said lid opposite said drinking spout, a weighted base member releasably attached to the lower surface of said cup member, said base member having a planar upper surface opposite said lower surface of said cup member, said base member having a convex sidewall that tapers from said upper surface to a lower horizontal planar bottom surface, at least one arcuate ridge on one of said upper and lower surface and a circular groove on the other of said upper and lower surface, said ridge and groove being sized such that said ridge is received in said groove in a closely mating and rotationally sliding manner, two resilient clips extending upwards from diametrically opposite edges of the upper surface of said base member, said clips extending upward along the outside of said sidewall of said cup member, facing in the same circumferential direction and being sized to resiliently clip on said handles upon rotation of said base member upon the lower surface of the cup member.

8. A self right cup as in claim 7, wherein said resilient clips are generally C-shaped forming openings sized to receive said handles, knobs are located at the ends of said clips partially enclosing said openings to resiliently lock said clips upon said handles.

9. A self righting cup as in claim 7, wherein said cup member, said lid and said base member are made of plastic.

10. A self righting cup as in claim 7, wherein a metal weight is located within said base member.

11. A self righting drinking cup comprising:

a hollow cup container having a substantially cylindrical vertical sidewall, a substantially planar horizontal bottom wall enclosing the bottom of said cup container, said bottom wall having a substantially planar lower surface, a weighted base member having an upper surface, a rounded convex outer surface that tapers from said upper surface to a planar horizontal bottom surface upon which the cup stands when placed upon a flat surface, said convex outer surface and said bottom surface are concentric to a vertical axis which passes through the center of said cup, cooperating means on said lower surface of said cup container and said upper surface of said base member to rotatably aligning said base member on said lower surface of said cup container, two arcuate-shaped handles extending out from diametrically opposite sides of said cup container, lower ends of said handles being attached to said sidewall adjacent the bottom edge of said sidewall, resilient clip means on said base member for resiliently clipping onto said lower ends of said handles upon rotation of said base member on said lower surface of said cup container thereby vertically and rotatably securing said base member on said lower surface of said cup container.

* * * * *